US006923709B2

(12) United States Patent
Chen et al.

(10) Patent No.: US 6,923,709 B2
(45) Date of Patent: Aug. 2, 2005

(54) CHEMICAL MECHANICAL POLISHING APPARATUS HAVING A MEASURING DEVICE FOR MEASURING A GUIDE RING

(75) Inventors: Chih-Kun Chen, Bade (TW); Shan-Chang Wang, Taoyuan Hsien (TW); Ching-Huang Chen, Taoyuan (TW)

(73) Assignee: Nanya Technology Corporation, Taoyuan (TW)

( * ) Notice: Subject to any disclaimer, the term of this patent is extended or adjusted under 35 U.S.C. 154(b) by 43 days.

(21) Appl. No.: 10/410,558

(22) Filed: Apr. 7, 2003

(65) Prior Publication Data

US 2003/0229468 A1 Dec. 11, 2003

(30) Foreign Application Priority Data

Jun. 7, 2002 (TW) ..... 91208493 U

(51) Int. Cl.[7] ..... B24B 49/00
(52) U.S. Cl. ..... 451/5; 451/6; 451/289
(58) Field of Search ..... 451/5, 6, 8, 41, 451/60, 173, 174, 288, 286, 289

(56) References Cited

U.S. PATENT DOCUMENTS 5,938,884 A * 8/1999 Hoshizaki et al. ..... 156/345.14
6,352,466 B1 * 3/2002 Moore ..... 451/5
6,390,908 B1 * 5/2002 Chen et al. ..... 451/398
6,626,734 B2 * 9/2003 Moore ..... 451/5

* cited by examiner

*Primary Examiner*—Joseph J. Hail, III
*Assistant Examiner*—Alvin J Grant
(74) *Attorney, Agent, or Firm*—Ladas & Parry LLP

(57) ABSTRACT

A CMP (chemical mechanical polishing) apparatus having a measuring device for measuring a guide ring. A polishing table is provided. A wafer loading/unloading device is located at a first side of the polishing table. A measuring device is located at a second side of the polishing table. A carrier having a first lateral and a second lateral opposite the first lateral, wherein the first lateral faces the polishing table, the wafer loading/unloading device or the measuring device. A guide ring is disposed on the first lateral of the carrier. A transfer device is disposed on the second lateral of the carrier and connected to the carrier, wherein the transfer device is used to move the carrier onto the polishing table, the wafer loading/unloading device or the measuring device. The measuring device is used to automatically and immediately measure the severity of scoring on the guide ring.

24 Claims, 4 Drawing Sheets

CHEMICAL MECHANICAL POLISHING APPARATUS HAVING A MEASURING DEVICE FOR MEASURING A GUIDE RING

BACKGROUND OF THE INVENTION

1. Field of the Invention

The present invention relates to a CMP (chemical mechanical polishing) apparatus, and more particularly, to a CMP apparatus having a measuring device for measuring a guide ring.

2. Description of the Related Art

Semiconductor fabrication often uses a combination of chemical and mechanical polishing to thin and planarize a thin film coating on a wafer. Typically, the wafer is placed in a polishing head and makes contact with a rotating polishing pad having slurry applied thereto. Often the polishing head holding the wafer also rotates, making the planarization process more uniform.

FIG. 1 is a cross section of a conventional polishing process. The wafers 120 are held in place laterally by the guide rings 150, 160. To facilitate thin film planarization, uniform pressure is applied mechanically from above to the carriers 130 holding the wafers 120 firmly against the polishing pad 110. To aid in maintaining uniform pressure to the carriers 130, a thin carrier film (also referred to as a backing film) 140 is usually attached to each carrier 130. The polishing table (also referred to as a turn table) 100 and polishing pad 110 are rotated at a set speed, while the carriers 130, carrier films 140 and wafers 120 often rotate at a second set speed. During automated loading and unloading, the wafer is secured to the carrier by vacuum pressure via passages (not shown).

During the CMP process, the wafer continuously hits the guide ring, resulting in a score on the guide ring. Out of tolerance scoring seriously affects the uniformity of the wafer during polishing. Moreover, scoring causes the wafer position to shift during loading and unloading, thereby causing the wafer to slide, drop, or break on the polishing table. Thus, when the guide ring has extensive scoring and no longer meets specifications, the guide ring should be discarded. In FIG. 1, symbol 150 shows the guide ring that has no scoring and symbol 160 shows the guide ring that has scoring.

Conventionally, the lifetime of the guide ring is determined by an experiential value by manually measuring the guide ring. This method, however, is difficult and ineffective in measuring the scoring. Thus, it is difficult to control yield by the conventional measuring method.

SUMMARY OF THE INVENTION

An object of the present invention is to provide an improved mechanism for automatically and immediately measuring a guide ring during polishing.

Another object of the present invention is to provide a CMP apparatus having a measuring device for measuring a guide ring.

In order to achieve these objects, the present invention provides a CMP apparatus having a measuring device for measuring a guide ring. A polishing table is provided. A wafer loading/unloading device is located at a first side of the polishing table. A measuring device is located at a second side of the polishing table. A carrier having a first lateral and a second lateral opposite the first lateral, wherein the first lateral faces the polishing table, the wafer loading/unloading device or the measuring device. The second lateral is opposite to the first lateral. A guide ring is disposed on the first lateral of the carrier. A transfer device is disposed on the second lateral of the carrier and connected to the carrier, wherein the transfer device is used to move the carrier onto the polishing table, the wafer loading/unloading device or the measuring device. The measuring device is used to automatically and immediately measure the severity of scoring on the guide ring.

The present invention improves on the prior art in that the CMP apparatus has a measuring device for automatically and immediately measuring a guide ring. Thus, the CMP apparatus of the present invention can monitor the severity of score of the guide ring on line, thereby exactly controlling the lifetime of the guide ring, raising yield and ameliorating the disadvantages of the prior art.

BRIEF DESCRIPTION OF THE DRAWINGS

The present invention can be more fully understood by reading the subsequent detailed description in conjunction with the examples and references made to the accompanying drawings, wherein.

DETAILED DESCRIPTION OF THE INVENTION

Figure 1:
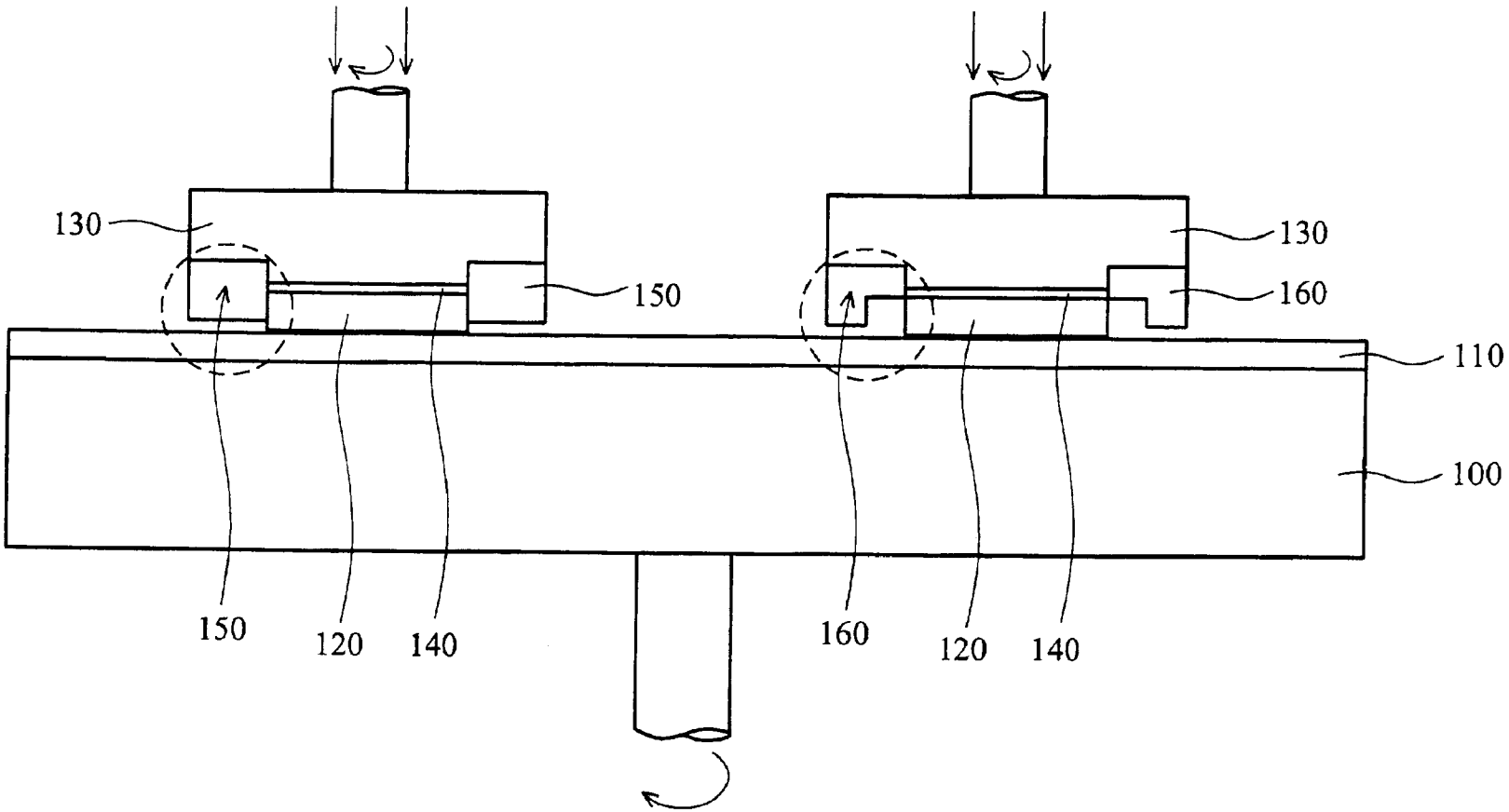
FIG. 1 (PRIOR ART)
FIG. 1 is a cross-section of a schematic representation of the CMP mechanism of the prior art.
Figure 2:
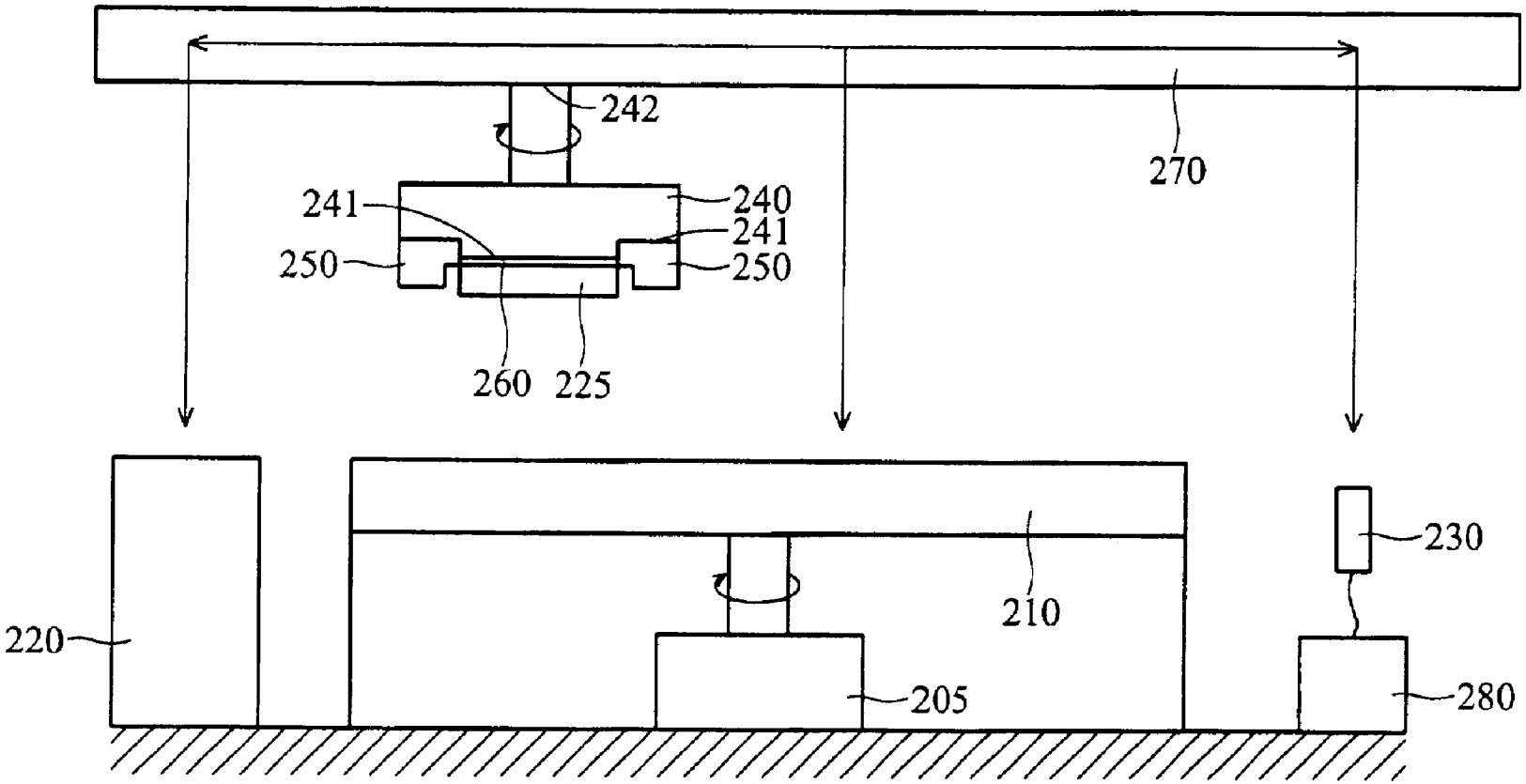
FIG. 2 is a sectional view showing a CMP mechanism of the present invention using a measuring device for measuring a guide ring.

FIGS. 2~5, show an embodiment of the present invention. FIG. 2 shows a sectional view of the CMP mechanism of the present invention.

In FIG. 2, an assembled CMP apparatus having a measuring device for measuring a guide ring is provided. A polishing table 210 is covered by a pad (not shown) to which polishing slurry (not shown) is applied. A driving device 205, such as a rotator, is disposed under the polishing table 210 to rotate the polishing table 210. During the CMP process, the polishing table 210 and the pad (not shown) are rotated at a fixed speed.

In FIG. 2, a wafer loading/unloading device (or pusher stage) 220 is located at a first side of the polishing table 210. The wafer loading/unloading device 220 is used to pack a wafer 225 onto a carrier 240 or unload the wafer 225 from the carrier 240.

In FIG. 2, a measuring device 230 is located at a second side of the polishing table 210.

In FIG. 2, a carrier 240 has a first lateral (an underside) 241 and a second lateral (an upside) 242 opposite the first lateral 241. The first lateral 241 faces the polishing table 210, the wafer loading/unloading device 220 or the measuring device 230.

In FIG. 2, a guide ring 250 is disposed on the first lateral 241 of the carrier 240. That is, the guide ring 250 is placed in a concentric groove or notch in the carrier 240. The wafer 225 is contained laterally by the guide ring 250 during polishing.

In FIG. 2, a backing film (also referred to as a carrier film) 260 is affixed to the underside (the first lateral 241) of the carrier 240 and located in the interior of the guide ring 250. Pressure is applied to the wafer 225 from the carrier 240 through the backing film 260 during polishing. The purpose of the backing film 260 is to absorb any imperfections in the carrier 240 and thus apply uniform pressure to the wafer 225. The pressure of the wafer 225 against the pad (not shown) containing the slurry results in the removal of the thin semiconductor film.

In FIG. 2, a transfer device 270, such as a robot, is disposed on the upside (the second lateral 242) of the carrier 240. The transfer device 270 is used to move the carrier 240 onto the polishing table 210, the wafer loading/unloading device 220 or the measuring device 230.

It should be noted that the measuring device 230 is used to measure the severity of scoring on the guide ring 250. The measuring device 230, preferably, uses a non-contact type detector, such as an optic sensor, for measuring the severity of scoring on the guide ring 250. For example, the measuring device 230 can use the laser displacement detector made by KEYENCE. In addition, the resolution of the measuring device 230 is, preferably, about 0.1 mm.

Moreover, the CMP apparatus of the present invention can include a controller 280 connected to the measuring device 230, as shown in FIG. 2. The controller 280, such as a computer, is used to analyze information from the measuring device 230.

Figure 3:
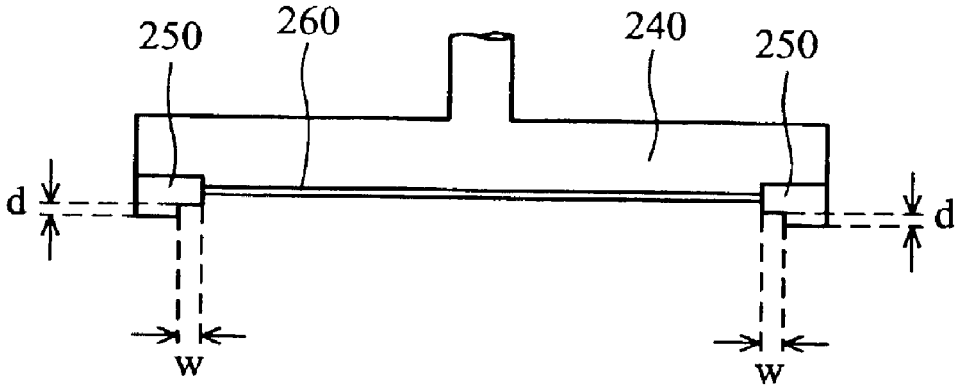
FIG. 3 schematically shows the scoring on the guide ring.

FIG. 3 shows a sectional view of the carrier 240 and the guide ring 250. Notice that the guide ring 250 has a score. The score size includes a width "w" and a depth "d". When the guide ring 250 has a certain extent of scoring and no longer meets specifications, the guide ring 250 should be discarded.

Figure 4:
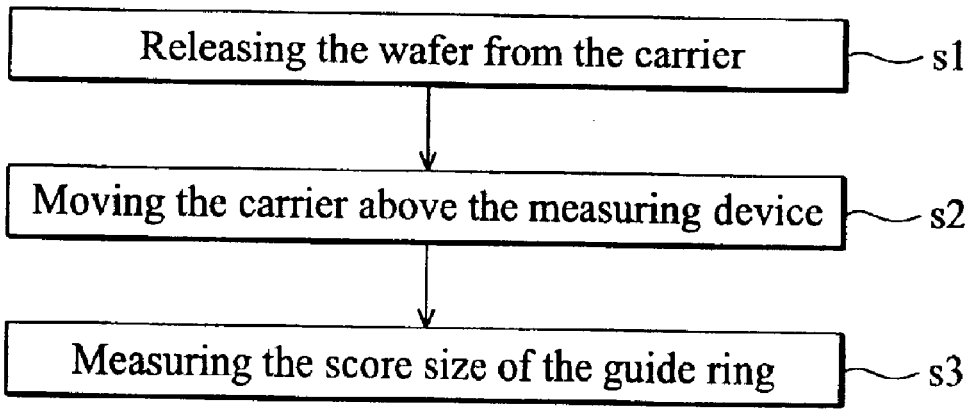
FIG. 4 is a flow chart illustrating a demonstrative operational flow of the present invention.

Referring now to FIGS. 2 and 4, there is shown a demonstrative operation flow of the present invention.

First, performing step s1, the carrier 240 is moved onto the wafer loading/unloading device 220 by the transfer device 270 to release the wafer 225 from the carrier 240.

Second, performing step s2, the carrier 240 is moved above the measuring device 230 by the transfer device 270. Moreover, a photo switch sensor (not shown) can be disposed between the polishing table 210 and the measuring device 230. The measuring device 230 is ON or OFF, and can be controlled by the photo switch sensor (not shown). For example, the photo switch sensor detects the passing time of the carrier 240 as it passes between the polishing table 210 and the measuring device 230, and can thus control the ON/OFF state of the measuring device 230.

Finally, performing step s3, the severity of scoring on the guide ring 250 is measured by the non-contact type measuring device 230. For example, after the guide ring 250 has moved back and forth once above the measuring device 230, data regarding the severity of scoring on the guide ring 250 is obtained.

Figure 5:
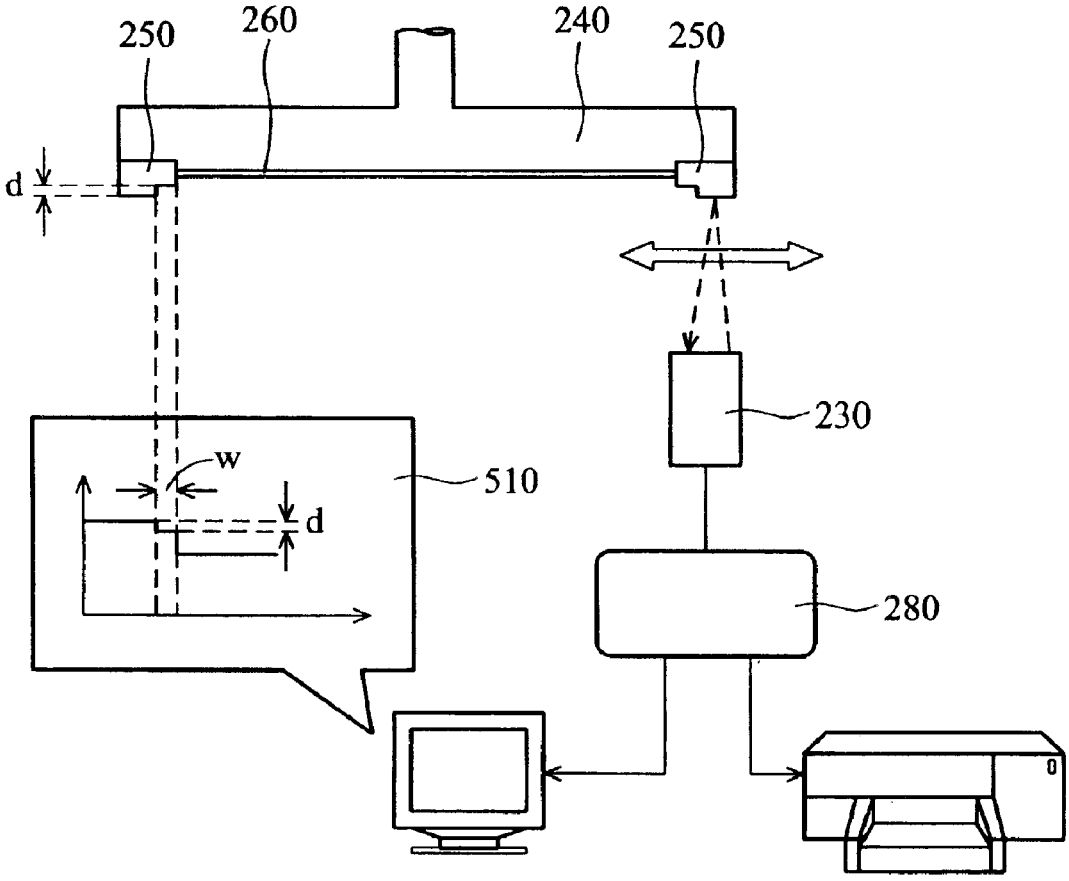
FIG. 5 illustrates the relationship between the guide ring and the measuring device according to an embodiment of the present invention.

FIG. 5 illustrates the relationship between the guide ring and the measuring device of the present invention. When the scored guide ring 250 passes above the measuring device 230, a diagram 510 of curves analyzed by the controller 280 is obtained. Because there are two drops from the upper surface of the guide ring 250 to the surface of the backing film 260, the width "w" and depth "d" of the score of the guide ring 250 is measured from the diagram 510.

In comparison with the prior art, the present CMP apparatus having a measuring device 230 for measuring the guide ring 250 of the present invention has the following advantages.

1. Because the present invention can automatically and immediately measure the severity of scoring on the guide ring, the polishing yield can be exactly controlled and thus improves uniformity during wafer polishing 2. Because the present invention can rapidly measure the severity of scoring several times in a short period, the experiential value of the lifetime of the guide ring is more accurate than that of the prior art.

3. The present invention is well suited to performing and analyzing a CMP experiment.

Finally, while the invention has been described by way of example and in terms of the above, it is to be understood that the invention is not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A CMP apparatus, comprising:

a polishing table;

a wafer loading/unloading device located at a side of the polishing table;

a measuring device located outwardly of a peripheral edge of the polishing table;

a carrier having a first lateral and a second lateral opposite the first lateral, wherein the first lateral faces the polishing table, the wafer loading/unloading device or the measuring device;

a guide ring disposed on the first lateral of the carrier; and a transfer device disposed on the second lateral of the carrier and connected to the carrier, wherein the transfer device is used to move the carrier onto the polishing table, the wafer loading/unloading device or the measuring device, wherein the measuring device has an unimpeded view of the guide ring so as to be able to measure severity of a scoring on the guide ring.

2. The CMP apparatus according to claim 1, further comprising:

a controller connected to the measuring device, wherein the controller is used to analyze information from the measuring device.

3. The CMP apparatus according to claim 1, further comprising:

a driving device connected to the polishing table, wherein the driving device is used to rotate the polishing table.

4. The CMP apparatus according to claim 1, further comprising:

a backing film disposed on the first lateral of the carrier and located in the interior of the guide ring.

5. The CMP apparatus according to claim 1, wherein the scoring comprises a width and a depth.

6. The CMP apparatus according to claim 5, wherein the measuring device is a non-contact type detector for measuring the width and the depth of the scoring.

7. A CMP apparatus, comprising:

a polishing table;

a wafer loading/unloading device located at a first side of the polishing table;

a measuring device located at a second side of the polishing table;

a carrier having a first lateral and a second lateral opposite the first lateral, wherein the first lateral faces the polishing table, the wafer loading/unloading device or the measuring device;

a guide ring disposed on the first lateral of the carrier; and a transfer device disposed on the second lateral of the carrier and connected to the carrier, wherein the transfer device is used to move the carrier onto the polishing table, the wafer loading/unloading device or the measuring device;

wherein the measuring device is used to measure severity of a scoring on the guide ring and a resolution of the measuring device is 0.1 mm.

8. A process of CMP, suitable for the CMP apparatus of claim 1, comprising the steps of:

moving the carrier onto the wafer loading/unloading device to release a wafer from the carrier;

moving the carrier outwardly of the peripheral edge of the polishing table and above the measuring device by the transfer device, wherein the measuring device has an unimpeded view of the guide ring;

measuring severity of a scoring on the guide ring by the measuring device and thus obtaining score severity information; and analyzing the information by a controller connected to the measuring device.

9. The CMP process according to claim 8, further comprising the step of:

rotating the polishing table by a driving device connected to the polishing table.

10. The CMP process according to claim 8, wherein the scoring comprises a width and a depth.

11. The CMP process according to claim 10, wherein the measuring device is a non-contact type detector for measuring the width and the depth of the scoring.

12. A process of CMP, suitable for the CMP apparatus of claim 1, comprising the steps of:

moving the carrier onto the wafer loading/unloading device to release a wafer from the carrier, moving the carrier above the measuring device by the transfer device;

measuring severity of a scoring on the guide ring by the measuring device and thus obtaining score severity information, wherein a resolution of the measuring device is 0.1 mm; and analyzing the information by a controller connected to the measuring device.

13. A CMP apparatus, comprising:

a polishing table containing a peripheral edge that is a first lateral distance from a center of the polishing table;

a wafer loading/unloading device located at a second lateral distance from the center of the polishing table, wherein the second lateral distance is greater than the first lateral distance;

a measuring device located at a third lateral distance from the center of the polishing table, wherein the third lateral distance is greater than the first lateral distance;

a carrier having a first lateral and a second lateral opposite the first lateral, wherein the first lateral faces the polishing table, the wafer loading/unloading device or the measuring device;

a guide ring disposed on the first lateral of the carrier; and a transfer device disposed on the second lateral of the carrier and connected to the carrier, wherein the transfer device is used to move the carrier onto the polishing table, the wafer loading/unloading device or the measuring device;

wherein the measuring device is used to measure severity of a scoring on the guide ring.

14. The CMP apparatus according to claim 13, further comprising:

a controller connected to the measuring device, wherein the controller is used to analyze information from the measuring device.

15. The CMP apparatus according to claim 13, further comprising:

a driving device connected to the polishing table, wherein the driving device is used to rotate the polishing table.

16. The CMP apparatus according to claim 13, further comprising:

a backing film disposed on the first lateral of the carrier and located in the interior of the guide ring.

17. The CMP apparatus according to claim 13, wherein the scoring comprises a width and a depth.

18. The CMP apparatus according to claim 17, wherein the measuring device is a non-contact type detector for measuring the width and the depth of the scoring.

19. The CMP apparatus according to claim 13, wherein a resolution of the measuring device is 0.1 mm.

20. A process of CMP, the process comprising:

moving a carrier, containing a guide ring, outwardly of a peripheral edge of a polishing table and above a measuring device, wherein the measuring device has an unimpeded view of the guide ring;

measuring severity of a scoring on the guide ring by the measuring device and thus obtaining score severity information; and analyzing the information by a controller connected to the measuring device.

21. The CMP process according to claim 20, further comprising:

rotating the polishing table by a driving device connected to the polishing table.

22. The CMP process according to claim 20, wherein the scoring comprises a width and a depth.

23. The CMP process according to claim 22, wherein the measuring device is a non-contact type detector for measuring the width and the depth of the scoring.

24. The CMP process according to claim 20, wherein a resolution of the measuring device is 0.1 mm.

* * * * *